US007305921B2

(12) United States Patent
Schölzig et al.

(10) Patent No.: US 7,305,921 B2
(45) Date of Patent: Dec. 11, 2007

(54) COMBINED PRINTING PRESS

(75) Inventors: Jürgen Schölzig, Mainz (DE); Hans-Willy Schütz, Alzenau (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 111 days.

(21) Appl. No.: 10/970,744

(22) Filed: Oct. 21, 2004

(65) Prior Publication Data

US 2005/0092196 A1 May 5, 2005

(30) Foreign Application Priority Data

Oct. 31, 2003 (DE) ..... 103 51 305

(51) Int. Cl.
*B41F 5/04* (2006.01)
*B41F 13/02* (2006.01)

(52) U.S. Cl. ..... 101/232; 101/239; 101/226; 271/10.01; 271/186

(58) Field of Classification Search ..... 101/226
See application file for complete search history.

(56) References Cited

U.S. PATENT DOCUMENTS 5,024,128 A * 6/1991 Campbell, Jr. ..... 83/26
5,189,103 A * 2/1993 Abe et al. ..... 525/133
6,027,270 A * 2/2000 Greive ..... 400/625
6,161,479 A * 12/2000 Murray ..... 101/453
6,349,641 B1 * 2/2002 Bayer et al. ..... 101/142
6,644,192 B2 * 11/2003 Dilling et al. ..... 101/480
6,651,539 B1 * 11/2003 Eicher et al. ..... 83/698.42
6,739,253 B2 * 5/2004 Schaum ..... 101/232
2001/0025577 A1 * 10/2001 Cousin et al. ..... 101/228
2002/0100379 A1 * 8/2002 Wiese ..... 101/148
2003/0221332 A1 * 12/2003 Maria de Vroome ..... 34/134
2004/0060463 A1 * 4/2004 Birkenfeld et al. ..... 101/219

* cited by examiner

*Primary Examiner*—Daniel J. Colilla
*Assistant Examiner*—Marissa Ferguson-Samreth
(74) *Attorney, Agent, or Firm*—Leydig, Voit & Mayer, Ltd

(57) ABSTRACT

In order to process inexpensive printing materials in connection with the processing of an extremely wide range of coating media, such as solvent-containing printing inks, and, moreover, in connection with variable format configuration and extremely flexible processing processes, provision is made to couple a web-fed rotary press and a sheet-fed rotary press to each other. For this purpose, a transfer assembly 7 in the form of a roll-sheet feeder is arranged between the presses.

10 Claims, 1 Drawing Sheet

COMBINED PRINTING PRESS

FIELD OF THE INVENTION

The invention relates to a printing press for processing webs and sheet printing material.

BACKGROUND OF THE INVENTION

Printing materials can be processed in presses in both sheet form and web form. Sheet-fed rotary presses or web-fed rotary presses are used in these instances. Sheet-fed rotary presses process printing material that is cut into sheets. The sheets are inserted into a feeder in stacks and from there are transported separately sheet by sheet through the press. With this arrangement, individual partial images can be applied in various printing units during sheet transport. The sheet-fed rotary press also can be configured to carry out so-called sheet turning in such a way that, after the sheet turning, the side of the printing material opposite the previously printed sided can be printed. Furthermore, a series of additional operations can be carried out within a sheet-fed rotary press. For instance, a drying system can be provided between the printing units. A coating of a varnish or special ink also can be provided before or after the printing units. Further processing operations in the form of punching, embossing, creasing, perforating or cutting operations can be carried out before, between or after the printing units. The press can also be connected to a quality control system, which envisages removing sheets from the sheet run.

Web-fed rotary presses are known for conveying the printing material through the machine in web form. With such presses, the printing material is taken from a roll and drawn continuously through the press. As a rule, the printing material is simultaneously printed from both sides. The configuration of the printing units can be very different and depends on the type of printing process and the end product. With a web-fed rotary press, different printing processes are known. The printing process for web-fed rotary presses can be offset printing or planographic printing, it can be flexographic printing or letterpress printing or use can be made of a gravure printing process. With web-fed rotary presses, printing inks of extremely different qualities can be used, depending on which of the aforementioned printing processes are used. For example, in flexographic printing and gravure printing, solvent-containing inks are used. As a result of the comparatively simple design of the web-fed rotary press, a protection mechanism for ensuring that solvent cannot escape outside the machine can be incorporated into the press quite easily.

The disadvantage with sheet-fed rotary presses is that processing using letterpress printing or gravure printing in conjunction with solvent-containing inks is relatively difficult. The disadvantage with the web-fed rotary press is that the press format cannot be varied and the printing material format used in the press is virtually fixed.

OBJECT AND BRIEF SUMMARY OF THE INVENTION

In view of the foregoing, an object of the invention is to make high-value printing processes available for use with comparatively low-value printing materials.

The advantage of the apparatus of the present invention is that low-value printing materials can be pre-coated in the web-fed rotary press. Additionally, first printing operations can be performed in the web-fed rotary press. Intermediate storage of the printing materials produced in this way is no longer necessary, since the cut printing materials can be supplied directly to a sheet-fed rotary press. These pre-coated or pre-printing materials can advantageously be processed further at a high level in the sheet-fed rotary press. In this case, coating operations are suitable. Further embossing or cutting processes can be used to finish the printing material.

DETAILED DESCRIPTION OF THE INVENTION

Figure 1:
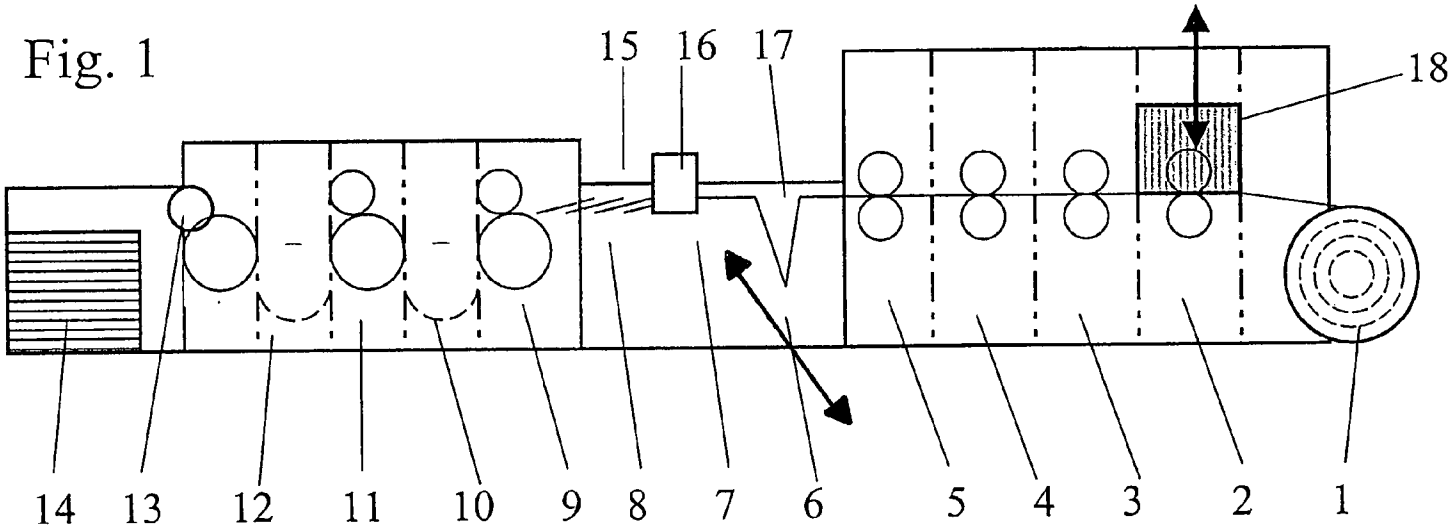
FIG. 1 is a diagrammatic view of an exemplary printing apparatus according to the present invention.
Figure 2:
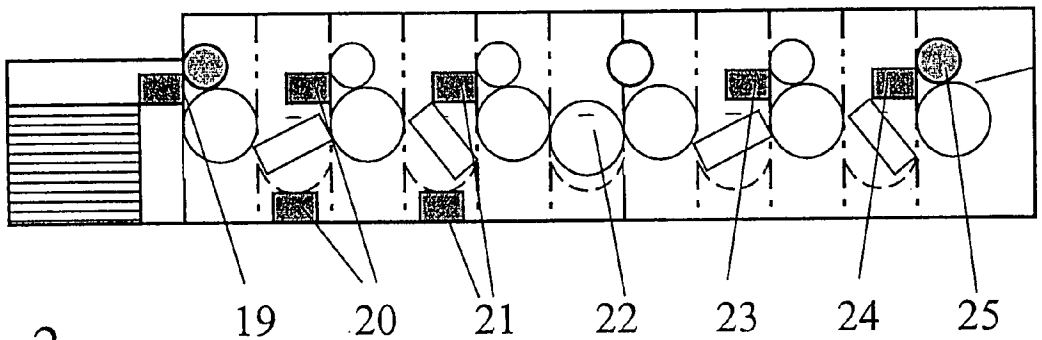
FIG. 2 is a diagrammatic view of an alternative embodiment of a printing apparatus according to the present invention.

FIG. 1 illustrates a web-fed rotary press having a roll changer 1 and printing units 2 to 5 that is assigned to a sheet-fed rotary press. The link between the web-fed rotary press and the sheet-fed rotary press is produced by means of a transfer assembly 6, for example a crosscutter 7.

The web-fed rotary press can be a flexographic press. Flexographic printing is a relief printing process that permits the production of very economical printing plates. Flexographic printing also permits the printing of water-containing or solvent-containing inks and UV inks for UV drying. In this way, an enhancement can be made to a low-value printing material before the printing process. For example, this can be carried out by applying white pigment or what is known as a primer. A primer is, for example, a type of base coat for the consolidation of the surface of the printing material. At the same time, the rear of the webs can be provided with specific adhesives and release agents. A screen printing unit also can be provided before the further printing units in the web-fed rotary press, for the processing of specific coating fluids.

Special operations can be carried out in specific printing units of the web-fed rotary press, which can be configured as withdrawable or replaceable cassettes 18. In this case, operations such as hot embossing or film embossing can be carried out continuously. Furthermore, the printing material can be laminated by means of a specific layer (for example plastic film, metal foil). Likewise, a silicone applicator unit can be provided in the web-fed rotary press. However, the web-fed rotary press can also have printing units in which operations are carried out using an offset or gravure printing process. The web-fed rotary press can also be provided with imagesetting devices for the production of printing forms on erasable surfaces or on printing plate blanks within the printing units.

The pre-treated printing material web is generally supplied to a cutting assembly after emerging from the web-fed rotary press. The cutting assembly can be integrated into the web-fed rotary press. The sheets emerging from the cutting assembly have a fixed format, which results from the web width and circumference of the form cylinder of the web-fed rotary press. This fixed format has to be processed in the transfer assembly 6. The transfer assembly 6 ensures that the individual sheets emerging from the web-fed rotary press after being cut in the crosscutter 7 can be transferred in an ordered sequence to the sheet-fed rotary press connected downstream. For example, a sheet feed system 8 in the form of a suction belt section can be provided, on which the sheets are transported downstream in a specific orientation. The sheets must arrive at the sheet feeder 8 of the sheet-fed rotary press in a specific order and with a specific spacing and chronological coordination. For this purpose, the orientation generally selected is an underlapped sheet stream. As a result, the sheets do not have to be accelerated excessively as they are supplied to the press, and a following sheet can follow a preceding sheet chronologically very quickly.

In one specific embodiment, the transfer assembly used for the sheet-fed rotary press can be a so-called roll-sheet feeder. The roll-sheet feeder can be designed as a feed assembly for a sheet-fed rotary press and normally has the following features:

- a roll carrier (which in the illustrated embodiment optionally can be used as an intermediate store for printed webs);
- a web guidance system (the web guidance system 17 in the illustrated embodiment or alternative the web guidance system can be designed as a storage assembly with festoons, similar to threading units in web-fed rotary machines with web edge control);
- a crosscutting assembly (the crosscutter 16 in the illustrated embodiment);
- a sheet underlapping system (the underlapping assembly 15 in the illustrated embodiment); and
- a sheet feed system (which is integrated in sheet-fed rotary machines).

Instead of a roll feed system, the feed of the web from the web-fed rotary press can now be chosen in the roll-sheet crosscutter. The web is guided into the crosscutter unit 16 by the existing web guidance system 17 and then converted into an underlapped sheet stream. The particular advantage of this configuration is that, during the operation of the crosscutter, the units for the suction head and double sheet sensing that are provided in the sheet-fed rotary press for the sheet separation of sheet stacks are not necessary. This is because, from the crosscutter 16, a sheet stream already aligned with high quality and underlapping is produced by the underlapping unit 15. The sheet stream is then supplied to the sheet feeder 8 over the belt table provided on the sheet-fed rotary press.

In the sheet-fed rotary press, the sheet is guided in a known manner through the existing printing units 9, 11, 13. Sheet guide modules 10, 12 are arranged between the printing units. In this case, a further printed image or an additional coating is applied to the coatings, prints or release layers already deposited on the sheets. In order to enhance the prints, a multicolor image is generally printed on the sheets. If so-called sheet turning is provided, the printing can be carried out on the front and rear sides of the sheets. Following the printing operation, a varnish can be applied (see, e.g., printing unit 13). The varnish can be applied in combination with a punching, embossing or cutting operation. In the illustrated embodiment, the punching or the embossing can be carried out in the region of a dry sheet (see printing units 19, 25). For treating the surface of the sheet, it is possible to integrate different types of radiant devices into the machine. The sheet-fed rotary press allows an extremely wide range of dryers 20, 21, 23, 24 or alternatively so-called discharge or corona devices to be employed between the printing units. Therefore, the surface of the printing material can be treated in the respective processing state so as to substantially enhance any downstream processing or such that the delivery carried out in a downstream sheet deliverer 14 is straightforward.

A sheet turning device 22 that enables sequential processing of both sides of the printed sheets can also be provided in the sheet-fed rotary press.

When transferring the printing material between the web-fed rotary press and the sheet-fed rotary press using a roll-sheet feeder, it is possible to use the two presses individually in their respective standard configurations as well. For this purpose, the roll-sheet feeder can be arranged on a rail system such that it can be pushed out of the area between the two presses. It is then possible to supply the sheet-fed rotary press conventionally with a sheet stack. On the other hand, the web-fed rotary press can divide the printing material into sheets, for example by means of a cutting unit, and deposit the printing material in a stack. Likewise, the printing material can be reeled up again.

Furthermore, by inserting a turner bar module between the web-fed rotary press and the roll-sheet roll crosscutter, rotation of the printing material web can be produced. The turner bar module can also be integrated into the web guidance system of the roll-sheet feeder.

In the area between the web-fed rotary press and the roll-sheet feeder, a web-specific drying technology can also be used that allows the web to be dried, cooled and rewetted over a comparatively short distance. This arrangement ensures that a smoothed printing material web that can be processed further in a straightforward manner is supplied to the roll-sheet feeder. The operation of the roll-sheet feeder is also suitable for processing films and foils. For this purpose, the roll-sheet feeder can be provided with an antistatic system. For processing paper, the roll-sheet feeder can likewise contain a rewetting device.

The sheet cutting operation in the crosscutter of the roll-sheet feeder is highly accurate and can be produced with a very small sheet length tolerance. In this way, given continuous coating processes in the web-fed rotary press, extremely different printing material sheet formats can also be produced. Thus, the adjustability of the format of the sheet-fed rotary press would be enhanced. On the other hand, given subject-dependent printing material processing in the web-fed press, the desired format can also be easily produced by the sheet crosscutter 16.

The coordination of the web-fed rotary press, crosscutter and the sheet-fed rotary press assemblies can be carried out in a relatively simple manner using presently known control systems. In this case, an electric shaft can be provided for coordinating the speed of the web-fed rotary press, the arrival of specific cutting lines within the crosscutter and the arrival of leading sheet edge cut in the sheet-fed rotary press with one another. For example, buffers that are arranged in festoons can be provided in the web guidance system 17 of the sheet crosscutter or that of the web-fed rotary press. The festoons can also be arranged in the feed system of the web from the web-fed rotary press to the roll-sheet feeder. Any problems with one of the presses caused by a fault in the other press can be eliminated in a straightforward manner. In the event of a fault in the web-fed rotary press, the sheet-fed rotary press simply idles. In the event of a fault in the sheet-fed rotary press, intermediate storage of the printing material sheets can be provided in the area of the sheet crosscutter.

The advantage of the printing and finishing arrangement of the present invention is primarily that a wide range of different types of printing materials can be processed and the initial printing material can be procured economically. Furthermore, the need for transport and storage capacities is dispensed with as a result of the direct transition from the web-fed rotary press to the sheet-fed rotary press.

Finally, with respect to health and workplace safety concerns, explosion-proof regions can provided in the web-fed rotary press for the use of solvent-containing inks or coating media to allow for complex printing processes. Solvent-containing inks offer the advantage of a more brilliant print appearance. For example, this applies to gold inks on labels, which can substantially increase the quality of the labels. Likewise, the application is beneficial to the recycling of the labels processed in such a manner.

List of reference symbols:

1 Roll changer
2 Printing unit
3 Printing unit
4 Printing unit
5 Printing unit
6 Transfer assembly
7 Crosscutter
8 Sheet feeder system
9 Printing unit
10 Sheet guide module
11 Printing unit
12 Sheet guide module
13 Printing unit
14 Sheet deliverer
15 Underlapping assembly
16 Crosscutting assembly
17 Web feed system
18 Withdrawable/replaceable cassette
19 Printing unit
20 Dryer
21 Dryer
22 Sheet turning device
23 Dryer
24 Dryer
25 Printing unit

What is claimed is:

1. An apparatus for processing sheets and webs of printing material comprising:

a web-fed rotary press for producing a processed material web;

a sheet-fed rotary press; and a roll-sheet feeder and the sheet-fed rotary press for dividing said processed printing material into printing material sheets and transferring the printing material sheets to the sheet-fed rotary press, the roll-sheet feeder being movable between a first position wherein the roll-sheet feeder is arranged between the web-fed rotary press and the sheet-fed rotary press and a second position wherein the roll-sheet feeder is withdrawn from between the web-fed rotary press and the sheet-fed rotary press.

2. The apparatus according to claim 1, wherein the roll-sheet feeder includes a crosscutter.

3. The apparatus according to claim 1, wherein the web-fed or sheet-fed rotary press contains printing units using an offset printing process.

4. The apparatus according to claim 1, wherein the web-fed or sheet-fed rotary press contains printing units using a flexographic printing process.

5. The apparatus according to claim 1, wherein the web-fed or sheet-fed rotary press contains printing units using a gravure printing process.

6. The apparatus according to claim 1, wherein the web-fed or sheet-fed rotary press includes varnishing units.

7. The apparatus according to claim 1, wherein the web-fed or sheet-fed rotary press includes embossing units.

8. The apparatus according to claim 1, wherein the web-fed or sheet-fed rotary press includes punching units.

9. The apparatus according to claim 1, wherein the web-fed or sheet-fed rotary press includes printing units using a screen printing process.

10. The apparatus according to claim 1, further including a plurality of dryers arranged in the web-fed or sheet-fed rotary press.

* * * * *